US007819695B2

(12) United States Patent
Sasaki et al.

(10) Patent No.: US 7,819,695 B2
(45) Date of Patent: Oct. 26, 2010

(54) MULTI-UNIT CONNECTOR

(75) Inventors: Yasuhiro Sasaki, Makinohara (JP); Shoji Yamamoto, Fujieda (JP); Tohru Kurosawa, Fujieda (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/222,946

(22) Filed: Aug. 20, 2008

(65) Prior Publication Data

US 2009/0053917 A1 Feb. 26, 2009

(30) Foreign Application Priority Data

Aug. 21, 2007 (JP) ..... 2007-214413

(51) Int. Cl.
*H01R 13/40* (2006.01)

(52) U.S. Cl. ..... 439/595; 439/752

(58) Field of Classification Search ..... 439/585, 439/752

See application file for complete search history.

(56) References Cited

U.S. PATENT DOCUMENTS

2004/0038589 A1* 2/2004 Takahashi et al. ..... 439/595
2004/0180576 A1* 9/2004 Hasebe ..... 439/595
2005/0048837 A1* 3/2005 Ichida et al. ..... 439/595
2005/0112943 A1* 5/2005 Sagawa et al. ..... 439/595
2005/0170704 A1* 8/2005 Ishikawa et al. ..... 439/752

FOREIGN PATENT DOCUMENTS

JP 10-270115 10/1998
JP 11-086948 3/1999
JP 2002-175851 6/2002

* cited by examiner

*Primary Examiner*—Hien Vu
(74) *Attorney, Agent, or Firm*—Edwards Angell Palmer & Dodge LLP

(57) ABSTRACT

A multi-unit connector is formed by mounting a plurality of unit connectors, in which a terminal is received in a terminal receiving section of a housing, into a connector frame. The housing includes a front opening, and the connector frame includes a wall covering the front opening. The wall has a hole for terminal insertion, and a positioning rib projectingly. The terminal is positioned without rattling by supporting the terminal between the positioning rib and an inner wall at a side opposite to the positioning rib of the terminal receiving section. The positioning rib is provided with a slant surface for supporting the terminal. Furthermore, an additional positioning rib is arranged symmetrically against the positioning rib about a center of the hole and the slant surfaces for supporting a top end of the terminal are formed facing to each other at the positioning rib and the additional positioning rib.

6 Claims, 8 Drawing Sheets

MULTI-UNIT CONNECTOR

The priority application Number Japan Patent Application 2007-214412 upon which this patent application is based is hereby incorporated by reference.

BACKGROUND OF THE INVENTION

1. Field of the Invention

This invention relates to a multi-unit connector structured by mounting a plurality of unit connectors receiving terminals in receiving sections of the each unit connector in a connector frame.

2. Description of the Related Art

FIG. 12A shows an embodiment of a multi-unit connector of the prior art (refer Patent document 1: Japan Patent Published Application No. H10-270115, FIGS. 10, 12)

A multi-unit connector 51 includes a frame 52 made of synthetic resin and a plurality of unit connectors 53 mounted in the frame 52. Each of the unit connectors 53 is structured by a rear housing 54 made of synthetic resin, a front housing 55 engaging with the rear housing 54 slidingly from a front side of the rear housing 54, and terminals 56 received in the front housing 55 and the rear housing 54.

By providing unit connectors 53, various kinds of terminals 56 with different sizes can be received in the frame 52 by small insertion force. Before mounting the unit connector 53 in the frame 52, the front housing 55 may be located so as to cover and protect the terminals 56. When connecting with a mating connector (not shown), the front housing 55 is pushed from a position shown in FIG. 12A in a rearward direction and engaged together with the rear housing 54.

The terminal 56 joined previously with an electric wire (not shown), as a terminal with wire, is inserted into the housings 54, 55 and locked by the lock lance 57 of the rear housing 54. The frame 52 includes a mating-connector receiving section 59 separated by a partition wall 58 for each of the unit connectors 53.

FIG. 13 shows the other embodiment of a multi-unit connector of the prior art (refer Patent document 2: Japan Patent Published Application No. 2002-175851, FIG. 1).

The multi-unit connector 61 includes a connector housing 62 made of synthetic resin, a front holder 64 made of synthetic resin for covering a wide opening 63 at a front end of the connector housing 62, terminals 66 with wire received in a terminal receiving section 65 of the connector housing 62, and a side spacer 67 for double-locking the terminals in the connector housing 62.

The connector housing 62 includes a partition wall 68 separating each of the terminal receiving sections 65, a flexible lock lance 69 for locking the terminal 66, and a rim 71 for positioning a projection 70 at a front end of the terminal 66 by engaging with the projection 70. The front holder 64 has a tapered opening 72 to be inserted a mating terminal of a mating connector (not shown) through the opening. Usually, for ensuring enough terminal locking force when the terminal size is small, a width of the lock lance 69 may be designed to be wide. Accordingly, a size of a hole corresponding to the lock lance 69 at the front end of the connector housing 62 for separating molding dies would be increased. However, by applying the front holder 64, the wide opening 63 at the front of the connector housing 62 can be covered by the front holder 64, and the hole for separating dies can be eliminated.

In the embodiment shown in FIG. 13, the front holder 64 is applied at the connector housing 62, in which the female terminals 66 are inserted. A multi-unit connector (not shown) applying a front holder holding a hoot area of a contact tab of a male terminal (not shown) is described in Patent document 3 (Japan Patent Published Application No. H11-86948, FIG. 1).

SUMMARY OF THE INVENTION

Objects to be Solved

According to the above multi-unit connector 51 as shown in FIG. 12, the terminal 56 is locked by the front housing 55 as a terminal protecting component, so that rattling of the terminal 56 in the front and rear housings 54, 55, and rattling of the unit connector 53 (the housings 54, 55) in the frame 52 may be increased by a larger accumulated dimensional tolerance. The front housing 55 is required for each of the unit connectors 53, so that a number of components and a cost may be increased. A space for locking the front housing 55 and the rear housing 54 with each other is required so that a size of the whole structure may be increased.

When connecting the connector, in which the possibility of rattling of the terminal 56 is large, with a mating connector, interference between the connectors may occur so that the connectors would be deformed or damaged. Chattering wear between the terminal and the mating terminal possibly occurs during connecting so that electric connectivity between the terminals would be reduced. Rattling between the frame 52 and the unit connector 53 may cause a similar problem.

According to the above multi-unit connector 61 as shown in FIG. 13, a front area of the horizontal partition wall 68 of the connector housing 62 performs a space, in which the lock lance 69 is bent. While the terminal 66 is inserted in the connector housing 62, the lock lance 69 pushes the terminal 66 in a direction perpendicular to an insertion direction, so that the projection 70 at the front end of the terminal 66 may abut on a rear end of the rim 71 for positioning the terminal 66 of the connector housing 62. Thereby, the terminal 66 may be not smoothly engaged in the rim 71. A space for locking the front holder 64 in the connector housing 62 is required, so that the size of the connector would be increased.

To overcome the above problem, an object of the present invention is to provide a multi-unit connector, which can prevent rattling between a terminal and a housing and rattling between a connector frame and the housing, and can smoothly and securely position the terminal in the connector housing with compact structure without increasing number of components.

In order to attain the object of the present invention, a multi-unit connector includes a plurality of unit connectors, which includes a housing having a terminal receiving section, into which a terminal is inserted, and a front opening; and a connector frame mounting the plurality of unit connectors therein, and including a wall for covering the front opening; and the wall is provided with a hole for mating terminal insertion, and a terminal positioning rib projecting from the wall; and the terminal positioning rib controls the terminal to be positioned without rattling between the terminal positioning rib and an inner wall of the terminal receiving section, opposed to the terminal positioning rib.

According to the above structure, the unit connector is assembled by inserting the terminal in the housing. By mounting the unit connector in the connector frame, the front opening is covered by the wall of the connector frame, and the terminal positioning rib projecting from the wall supports controls a front end of the terminal to be positioned without rattling between the terminal positioning rib and an inner wall of the terminal receiving section opposed to the terminal positioning rib. By positioning the inner wall of the terminal receiving section of the housing and the terminal positioning rib of the connector frame through the terminal, rattling between the housing and the connector frame is prevented. A mating terminal of a mating connector is inserted through the hole of the wall of the connector frame into the terminal receiving section of the housing and connected with the terminal.

A case that a female terminal is received in the housing is described above. In case that a male terminal is received in the housing, a front half portion of a contact portion of a male terminal projects forward from the hole and a terminal positioning rib positions a middle edge (step) continuous to the contact portion of the male terminal.

In the multi-unit connector according to the present invention the housing may further include a terminal lock lance, and a front end of the terminal lock lance opposes to a top end of the terminal positioning rib.

According to the above structure, the terminal in the housing is locked by the terminal lock lance, and urged toward the inner wall of the terminal receiving section by a bias force of the terminal lock lance. The terminal positioning rib prevents moving and rattling of the terminal caused by a force larger than the bias force.

In the multi-unit connector according to the present invention may include a pair of the terminals, and a pair of the terminal positioning ribs corresponding to the pair of the terminals, and the housing may be provided with a partition wall between the pair of the terminals, and a front end of the partition wall is inserted in between the pair of the terminal positioning ribs.

According to the above structure, the front end of the partition wall is inserted in between the pair of the terminal positioning ribs, so that the housing is positioned in the connector frame, and position mismatching of the terminal in the housing and the hole for mating terminal insertion of the connector frame is prevented.

In the multi-unit connector according to the present invention the terminal positioning rib is provided with a slant surface for positioning a top end of the terminal.

According to the above structure, when the terminal is inserted in the housing, the top end of the terminal simultaneously abuts on the slant surface of the terminal positioning rib. The top end of the terminal is urged toward the opposed inner wall of the housing, so that rattling of the terminal in a front/rear direction and an upper/lower direction can be securely prevented, and rattling between the housing and the connector frame can be securely prevented through the terminal.

In the multi-unit connector according to the present invention an additional terminal positioning rib may be arranged at the wall symmetrically against the positioning rib with respect to a center of the hole, and a slant surface for positioning a top end of the terminal is formed respectively at the positioning rib and the additional positioning rib so as to oppose to each other.

According to the above structure, the top end of the terminal is inserted between both terminal positioning ribs, and supported positioned centrally without rattling in the upper/lower direction by the slant surfaces of the both terminal positioning ribs. The slant surface of the additional terminal positioning rib supports the top end of the terminal. The inner wall of the terminal receiving section supports a rear portion of the terminal.

In the multi-unit connector according to the present invention is the terminal positioning rib may be arranged at four directions of two horizontal directions and two vertical directions around a center of the hole, and a slant surface for positioning a top end of the terminal is formed respectively at a side, facing the center of the hole, of the each terminal positioning rib.

According to the above structure, the top end of the terminal is inserted among the terminal positioning ribs arranged rectangularly, and supported and positioned centrally without rattling in the front/rear direction and the upper/lower direction by the slant surfaces of the terminal positioning ribs. The slant surface of each of the terminal positioning ribs supports the top end of the terminal. The inner wall of the terminal receiving section supports a rear portion of the terminal.

In the multi-unit connector according to the present invention the terminal positioning rib may be formed with a circular shape around a center of the hole, and a tapered surface for positioning a top end of the terminal is formed at a side, facing the center of the hole, of the terminal positioning rib.

According to the above structure, the top end of the terminal is inserted into the circular-shape terminal positioning ribs, and supported and positioned centrally without rattling in all directions including the front/rear direction and the upper/lower direction by the tapered surfaces of the terminal positioning ribs. The tapered surface of the terminal positioning rib supports the top end of the terminal. The inner wall of the terminal receiving section supports a rear portion of the terminal.

According to the present invention, moving and rattling of the terminal in the housing are prevented by the terminal positioning rib. Rattling between the housing and the connector frame is prevented through the terminal positioning rib. Thereby, damage, which is caused by abutting of the terminal in the housing and the mating terminal when connecting with the mating connector, is prevented, and wear of the terminal by vibration after connecting is prevented, so that reliability of connecting by the connector is improved. It is not required that the housing is structured by two components as a housing by prior art, so that the number of the components is reduced and cost thereof can be decreased, and the size of the connector can be designed compact by eliminating increase of structure size caused by locking the two components.

According to the present invention, the terminal can be positioned securely and flexibly by the bias force of the terminal lock lance and a holding force of the terminal positioning rib, and thereby, rattling of the terminal can be prevented.

According to the present invention, the partition wall of the housing is inserted in between the pair of the terminal positioning ribs, and thereby, the housing can be positioned in the connector frame, so that position mismatching of the terminal in the housing and the hole for mating terminal insertion of the connector frame is prevented, and the terminal can be connected smoothly with the mating terminal.

According to the present invention, the top end of the terminal is smoothly and securely positioned along the slant surface of the terminal positioning rib, and rattling of the terminal in the housing in the front/rear direction and the upper/lower direction can be securely prevented, and rattling between the housing and the connector frame can be securely prevented through the terminal.

According to the present invention, the top end of the terminal is supported positioned centrally without rattling in the upper/lower direction by the slant surfaces of the both terminal positioning ribs, so that position mismatching of the terminal in the housing and the hole for mating terminal insertion of the connector frame is prevented, and rattling between the housing and the connector frame is prevented through the terminal.

According to the present invention, the top end of the terminal is supported and positioned centrally without rattling in the front/rear direction and the upper/lower direction by the slant surfaces of the terminal positioning ribs arranged rectangularly. Position mismatching of the terminal and the mating terminal inserted in the hole of the connector frame is securely prevented, and rattling between the housing and the connector frame is securely prevented through the terminal.

According to the present invention, the top end of the terminal is supported and positioned centrally without rattling in all directions including the front/rear direction and the upper/lower direction by the tapered surfaces of the circular shape terminal positioning ribs. Position mismatching of the terminal and the mating terminal inserted in the hole of the connector frame is securely prevented, and rattling between the housing and the connector frame is securely prevented through the terminal.

The above and other objects and features of this invention will become more apparent from the following description taken in conjunction with the accompanying drawings.

DESCRIPTION OF THE PREFERRED EMBODIMENT

FIGS. 1-6 show an embodiment of a multi-unit connector according to the present invention.

First Embodiment

Figure 1:
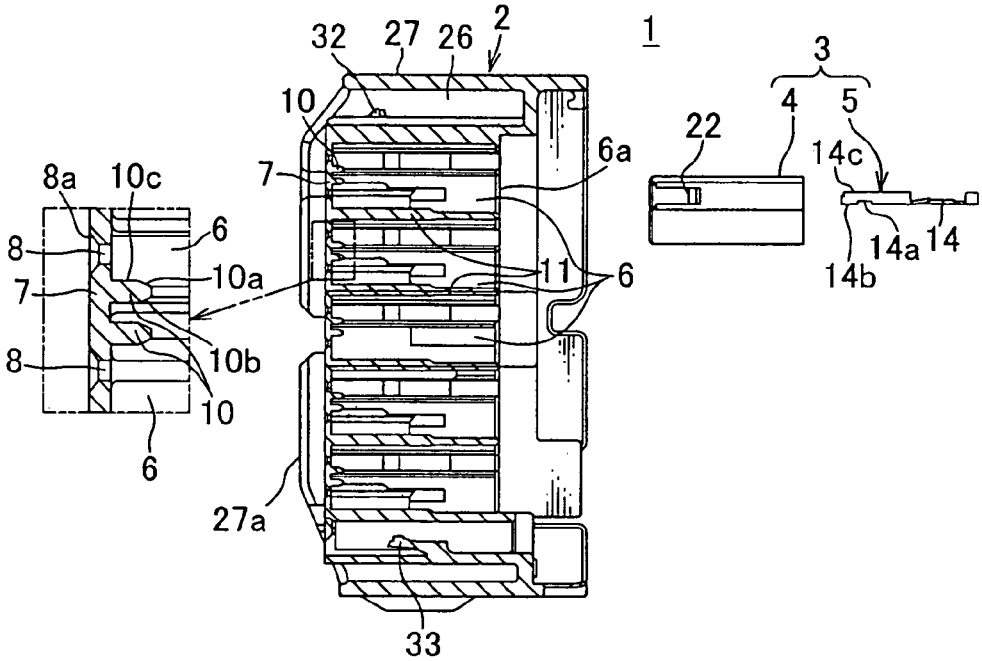
FIG. 1 is a vertical cross-sectional view including a partial enlarged section of a multi-unit connector before assembling of an embodiment according to the present invention.
Figure 2:
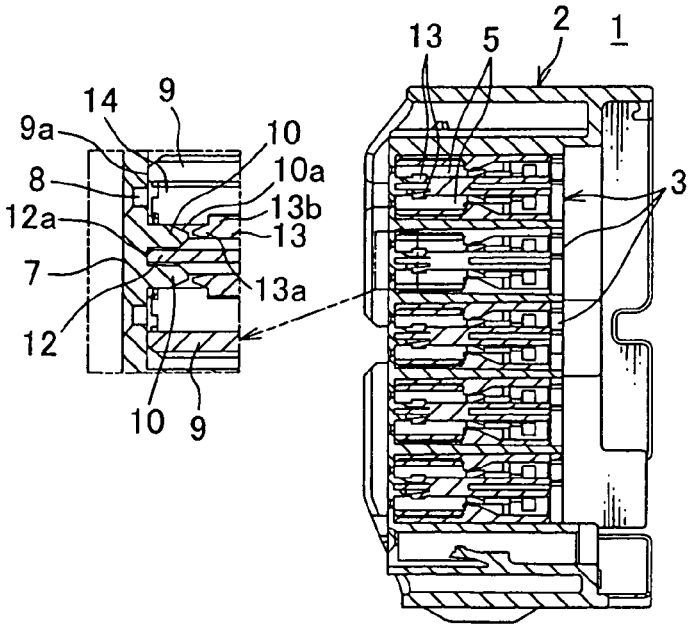
FIG. 2 is a vertical cross-sectional view including a partial enlarged section of the multi-unit connector after assembling of the embodiment shown in FIG. 1.
Figure 12A:
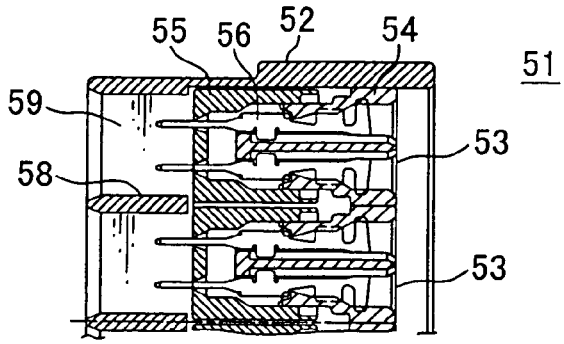
FIG. 12A PRIOR ART
FIG. 12A is a vertical cross-sectional view of a multi-unit connector of one embodiment by prior art.
Figure 12B:
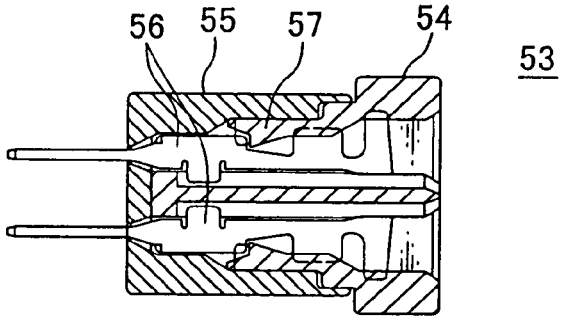
FIG. 12B PRIOR ART
FIG. 12B is a vertical cross-sectional view of a unit connector of the multi-unit connector shown in FIG. 12A.
Figure 13:
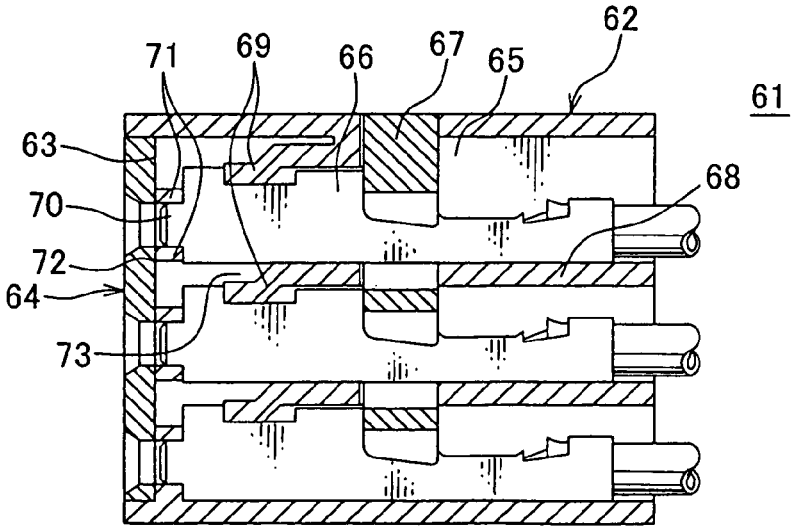
FIG. 13 PRIOR ART
FIG. 13 is a vertical cross-sectional view of a multi-unit connector of the other embodiment by prior art.

As shown in FIGS. 1, 2, the multi-unit connector 1 includes a connector frame 2 made of synthetic resin, and a plurality of unit connectors 3 inserted and locked in the connector frame 2. The unit connector 3 has a housing 4 made of synthetic resin, and a metallic female terminal 5 inserted and locked in the housing 4. For reducing the number of components, the unit connector 3 is provided with one-piece housing 4, not provided with two, front and rear, housings as a usual unit connector shown in FIG. 12.

The connector frame 2 includes a plurality of receiving sections 6 with rectangular vertical cross-section corresponding to number of the unit connectors 3 in parallel along an upper/lower direction. A rear end of each of the receiving sections 6 is opened (a rear opening 6*a*), and a front end of each of the receiving sections 6 is covered by a vertical wall 7. The wall 7 is provided with a hole 8 for a male-terminal insertion of a mating connector (not shown) and a terminal positioning rib 10 on an inner surface of the wall 7 in the vicinity of the hole 8 for supporting a top end of the female terminal 5 in cooperation with a horizontal inner wall 9 of the housing 4, opposed to the terminal position rib 10.

As shown in FIG. 1, the wall 7 at a front end of the housing 4 is formed perpendicularly to and integrally with upper and lower partition walls 11 parallel to each other of each receiving section 6. In the embodiment, a direction of "front", "front side" and the like is defined as facing the mating connector and the mating terminal along a direction of insertion, and a position of "front", "front side" and the like is defined as an end point nearest the mating connector along the direction of insertion. Upper/lower direction is defined as a direction perpendicular to the direction of insertion.

A pair of the terminal positioning ribs 10 is arranged above and below, close to each other and facing to each other, corresponding to each of upper and lower terminals 5 provided back to back (symmetrically above and bellow) in the unit connector 3. One hole 8 for mating-terminal insertion is located adjacent to and below the lower terminal positioning rib 10, and another hole 8 for mating-terminal insertion is located adjacent to and above the upper terminal positioning rib 10. A tapered surface 8*a* for guiding the male terminal is formed at an entrance (a front end) of the each of holes 8.

The terminal positioning rib 10 projects approximately twice the length of a thickness of the wall 7 from the wall 7. The terminal positioning rib 10 extends rearward horizontally with a plate shape. The terminal positioning rib 10 has upper and lower tapered surfaces 10*a*, 10*b* at a top end thereof. As shown in FIG. 2, the tapered surface 10*a* abutting on the top end of the terminal 5 is formed larger and the tapered surface

10*b* contacting with a central partition wall 12 of the housing 4 in the unit connector 3 is formed smaller.

As shown in FIG. 2, when the unit connector 3 is mounted in the connector frame 2, the top end of each of the terminal positioning ribs 10 faces to and approaches to a thin top end (front end) 13*a* of an elastic terminal lock lance 13 in the housing 3 of the unit connector 3, and a projecting portion 13*b* of the lock lance 13 engages with a recess 14*a* (FIG. 1) of a front-half box-shape (rectangular tubular shape) electric contact portion 14 of the terminal 5. A side surface 10*c* of the positioning rib 10 abuts on an outer surface 14*b* (FIG. 1) continuous to a front side of the recess 14*a* of the terminal 5. A horizontal outer surface 14*c* (FIG. 1) of the electric contact portion 14 of the terminal 5 abuts on the horizontal inner wall 9 in the housing 4 of the unit connector 3. Thereby, the top end of the electric contact portion 14 of the terminal 5 is positioned securely without rattling in the upper/lower direction between the inner wall 9 and the terminal positioning rib 10. Therefore, when connecting with the mating connector (not shown), the mating male terminal (not shown) is inserted smoothly into the electric contact portion 14 of the female terminal 5 with no displacement and no interference.

The lock lance 13 pushes the terminal 5 toward the inner wall 9 of the housing 4 by an elastic force thereof. The positioning rib 10 is a rigid projection, so that a slight gap, which allows the top end of the terminal 5 to be inserted in between the positioning rib 10 and the inner wall 9, is required, and rattling of the terminal 5 in the housing 4 is controlled in a range corresponding to the gap.

The horizontal inner wall 9 of the housing 4 faces to an urging direction (opposite direction of bending) of the lock lance 13. A top end (front end) 9*a* of the inner wall 9 abuts perpendicularly with no gap on the front vertical wall 7 of the connector frame 2. The terminal 5 is pushed on the inner wall 9 by the elastic force (bias force) of the lock lance 13. The positioning rib 10 prevents rattling of the terminal 5 in the upper/lower direction so as to abut on the terminal 5, which intends to move in a direction opposite to the urging direction against the bias force of the lock lance 13 by a vibration when connecting with the mating connector or driving.

Figure 3:
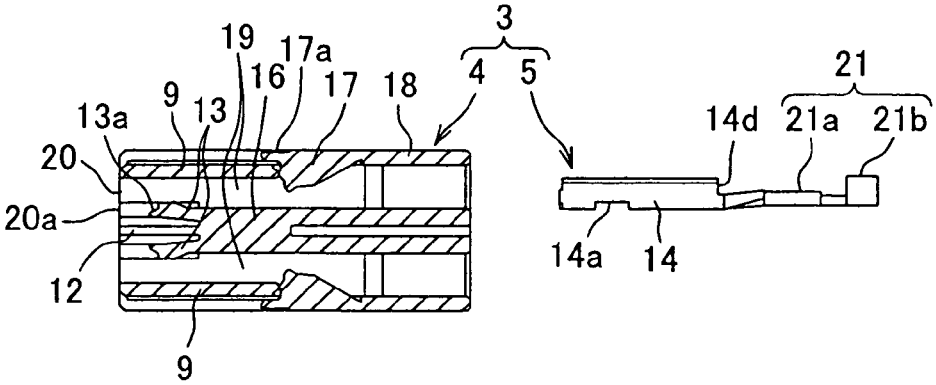
FIG. 3 is a vertical cross-sectional view of a unit connector before assembling of the multi-unit connector shown in FIG. 1.
Figure 4:
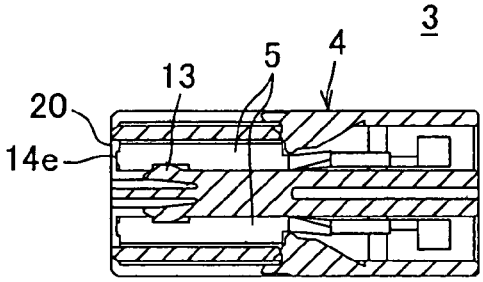
FIG. 4 is a vertical cross-sectional view of the unit connector after assembling of the multi-unit connector shown in FIG. 1.

As shown in FIGS. 3 and 4, the unit connector 3 includes the housing 4 and a female terminal 5. The housing 4 includes a horizontal thick partition wall 16 at a middle in the upper/lower direction, a pair of horizontal front-half thin inner walls 9 opposing to each other at upper and lower positions of the housing 4, a pair of small first lock lances 13 formed symmetrically in the upper/lower direction and integrally with a top end of the thick partition wall 16, the horizontal thin partition wall 12 extending between the pair of lock lances 13 forward from the thick partition wall 16, a pair of flexible large second lock lances 17 for double lock located in a middle in the front/rear direction of the housing 4 and at each rear end of the upper/lower inner wall 9, a pair of horizontal outer walls 18 located at rear half portion of the housing 4 and continuous to each rear end of the second lock lances 17, and a pair of vertical outer walls located at right/left sides of the terminal receiving section 19.

As shown in FIG. 2, the horizontal thin partition wall 12 in the middle of the housing 4 is inserted between the pair of upper/lower positioning ribs 10 so as to remain a small gap, and a front end 12*a* of the partition wall 12 abuts perpendicularly on an inner surface of the wall 7 at the front end of the connector frame 2. As shown in FIG. 3, the upper/lower inner walls 9 extending the front-half of the housing 4 are located closer to the front end than the outer walls 18. In FIG. 3, when a plurality of terminals 5 is arranged in parallel along the left/right direction in the housing 4, the receiving section 19 is partitioned by a vertical partition wall and the upper/lower partition walls 16 and the inner wall 9. The terminal receiving section 19 has an opening 20 opened wide at a front end thereof, and the opening 20 is integrally continuous to an opening 20*a* in front of the first lock lance 13.

The female terminal 5 includes the front-half rectangular-tubular-shape electric contact portion 14 having an elastic contact piece (not shown) inside thereof, and a rear-half wire joint portion (crimp contact portion) 21 continuous to the electric contact portion 14. The recess 14*a* to be engaged with the first lock lance 13 is formed at a front side of the electric contact portion 14. The second lock lance 17 engages with a rear end 14*d* of the electric contact portion 14.

As shown in FIG. 4, when the terminal 5 is locked, a front end 14*e* of the terminal 5 is located slightly behind the front opening of the housing 4. A conductive core of an electric wire (not shown) is joined at a wire crimp piece 21*a* at a front side of the wire joint portion 21 by crimp, and insulation cover of the electric wire is fixed at cover crimp piece 21*b* at a rear side of the wire joint portion 21. Instead of crimp, the electric wire can be joined by pressure contact. The terminal 5 can be released from the housing 4 by inserting a release jig (not shown) through the front opening 20*a* of the housing 4 in condition shown in FIG. 4 and bending the front end 13*a* of the first lock lance 13 in a lock release direction, and simultaneously by pushing and bending an outwardly-exposed top end 17*a* of the second lock lance 17 in a lock release direction by a jig rod (not shown).

Figure 5:
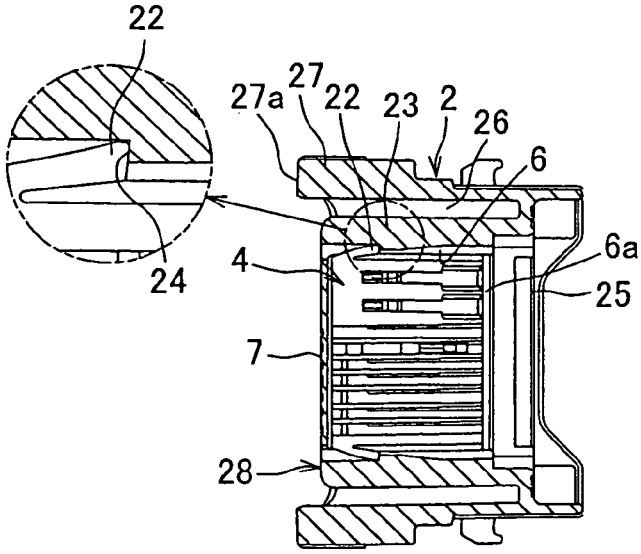
FIG. 5 is a horizontal cross-sectional view including a partial enlarged section of the multi-unit connector shown in FIG. 1.

As shown in FIG. 5 (horizontal cross-sectional view), the unit connector 4 has a flexible slant lock arm 22 at right and left sides at a front end thereof, and the connector frame 2 has a step 24 engaging with a rear end of the lock arm 22 at each of right and left front inner surfaces thereof. The unit connector 3 is inserted from a rear opening 25 through a rear opening 6*a* of the receiving section 6 into the connector frame 2, and fixed in the connector frame 2 by the lock arms 22.

A hood 27 is arranged through a space 26 at an outside of right/left side walls 23 of the connector frame 2, and extends upward and downward so as to form a rectangular-tubular shape as shown in FIG. 1. A side front portion 27*a* of the hood 27 projects ahead of a front end of the inner wall 23 so as to smoothly guide the mating connector (not shown) to a unit connector receiving section 28. Inside the hood 27, the mating connector is locked by a lock projection 32 (FIG. 1). A lock lance 33 shown in FIG. 1 can be arranged to correspond to a large unit connector (not shown) at a lower portion of the connector frame 2.

Figure 6A:
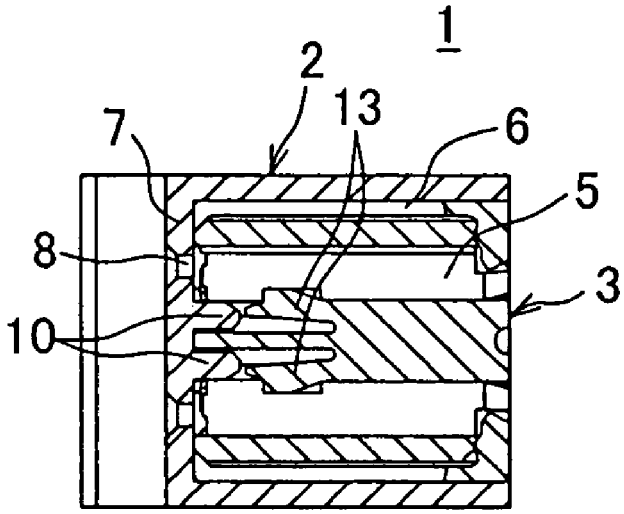
FIG. 6A is a vertical cross-sectional view of the multi-unit connector having a positioning rib.
Figure 6B:
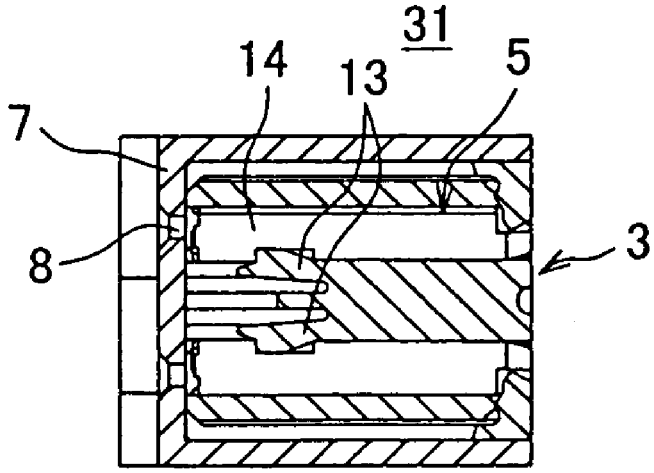
FIG. 6B is a vertical cross-sectional view of the multi-unit connector having no positioning rib.

FIG. 6A shows the multi-unit connector 1 with the positioning rib 10 according to the embodiment. FIG. 6B shows the multi-unit connector with no positioning rib.

In FIG. 6B, when the terminal 5 is inserted in the unit connector 3, the terminal 5 can be positioned in the right/left direction by vertical walls (not shown) of the terminal receiving section, but not positioned sufficiently in the upper/lower direction since the lock lance 13 is flexible. Thereby, when inserting the mating terminal (not shown), the terminal 5 may be rotated. Even if a terminal positioning rib (not shown) is provided in the unit connector 3, the meting terminal could abut on the front end of the rectangular shape electric contact portion 14, which is located at the hole 8 for mating terminal insertion at the front end of the connector frame 2, because of rattling between the connector frame 2 and the unit connector 3.

In case that the positioning rib 10 is arranged behind the hole 8 for mating terminal insertion as shown in FIG. 6A, the terminal 5 can be positioned securely against the hole 8 for mating terminal insertion, so that it can be surely prevented that the terminal 5 abuts on the mating terminal. Since the top end of the terminal 5 is positioned by the positioning rib, even if bending the terminal by mating terminal insertion is large, the terminal 5 can be securely positioned. The positioning rib 10 can also limit a slant of the terminal 5 and rattling of the unit connector 3 in the connector frame 2.

Second Embodiment

Figure 7:
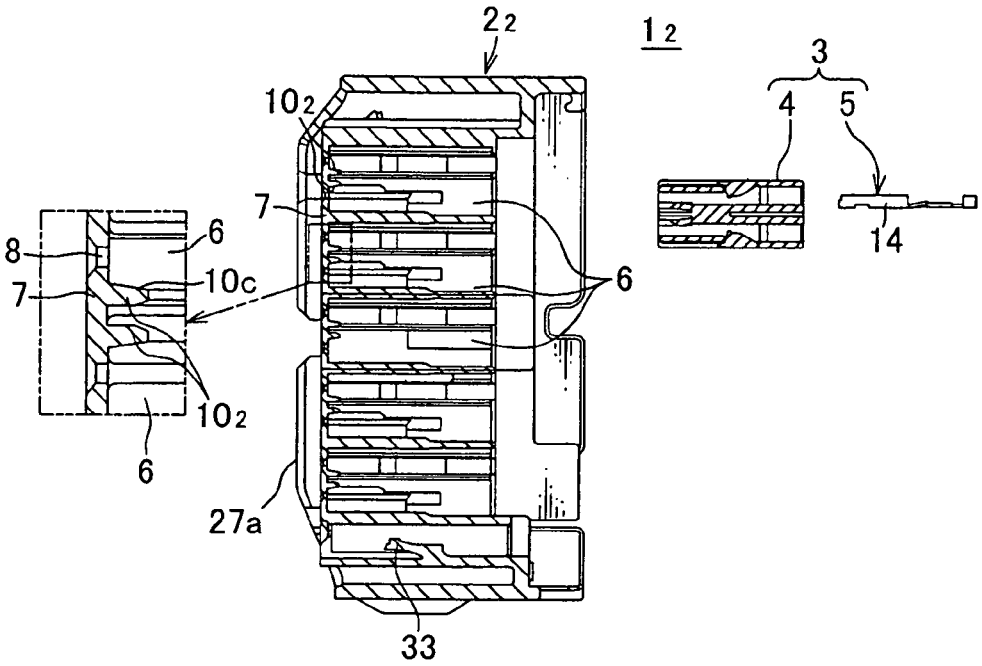
FIG. 7 is a vertical cross-sectional view including a partial enlarged section of a multi-unit connector before assembling of the other embodiment according to the present invention.
Figure 8:
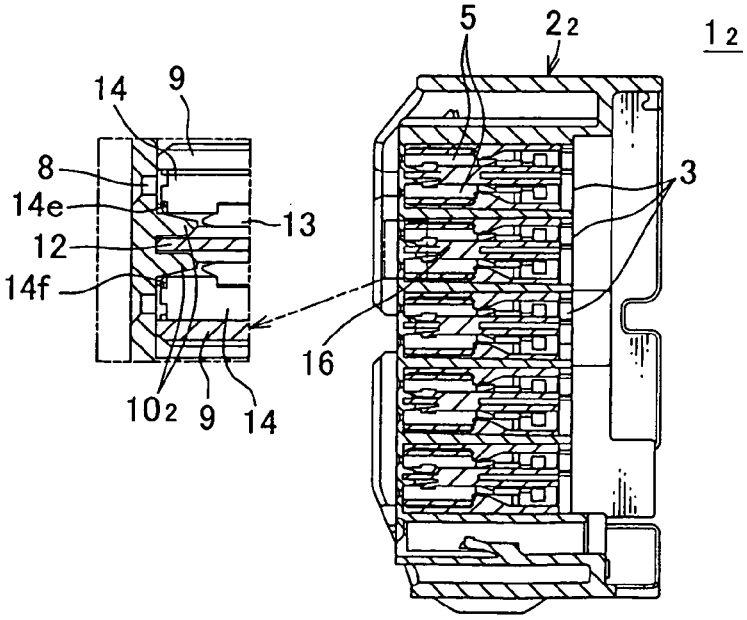
FIG. 8 is a vertical cross-sectional view including a partial enlarged section of the multi-unit connector after assembling of the other embodiment shown in FIG. 7.

FIGS. 7 and 8 show the other embodiment of the multi-unit connector according to the present invention.

In the multi-unit connector $\mathbf{1}_2$, the positioning rib $\mathbf{10}_2$ projecting rearward from the wall 7 at the front end of the connector frame $\mathbf{2}_2$ is tapered for limiting rattling of the terminal 5 in the unit connector 3. The structure other than the positioning rib $\mathbf{10}_2$ is the same as the embodiment shown in FIGS. 1-6, so that by adapting the same marking on the same components and detailed description about the components is omitted.

In an example shown in FIGS. 7 and 8, the positioning rib $\mathbf{10}_2$ is gradually thinner toward the top end thereof to provide a slant surface 10*c* to be contact with the terminal 5. As shown in FIG. 8, horizontal sides of a lower top end 14*e* of one female terminal 5 and an upper top end 14*f* of another female terminal 5 abut on each middle portion of corresponding slant surface 10*c* of the positioning rib $\mathbf{10}_2$ so as to push each of the other horizontal sides of the terminals 5 to each of horizontal upper and lower inner walls 9 of the housing 4, so that the terminals 5 are positioned in the upper/lower direction (a direction and an opposite direction of bending the lock lance 13) to prevent rattling of the terminals 5 in the housing 4.

FIGS. 9A-11D show respectively multi-unit connectors having variations of the positioning rib with a similar slant surface as shown in FIGS. 7-8. Main structure of the multi-unit connector is the same as that shown in FIGS. 7 and 8, so that only basic components are shown in FIGS. 9A-11D and components as same as that in FIGS. 9A-11D are putted with the same markings and detailed description about that is omitted.

Figure 9A:
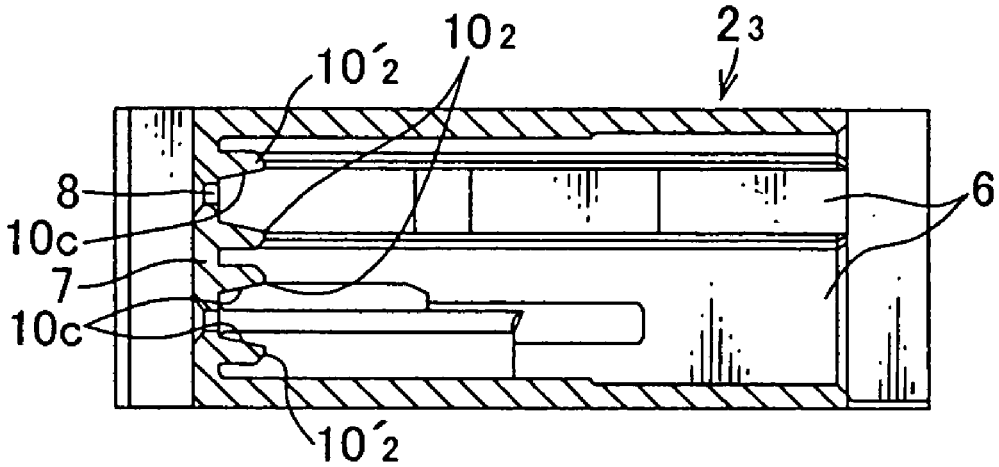
FIG. 9A is a vertical cross-sectional view of a connector frame showing a second embodiment of a positioning rib before assembling of a multi-unit connector.
Figure 9B:
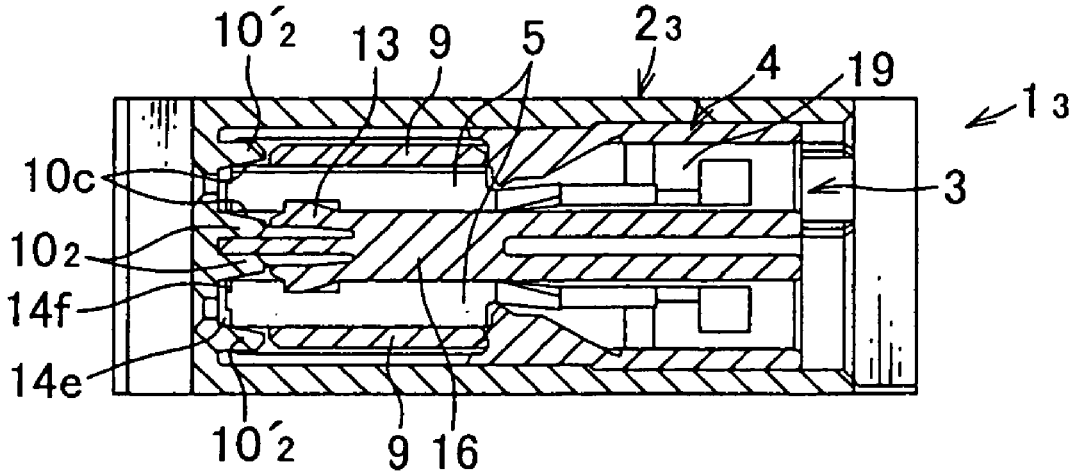
FIG. 9B is a vertical cross-sectional view of the multi-unit connector after assembling of the multi-unit connector shown in FIG. 9A.

FIG. 9A only shows an illustration of a connector frame $\mathbf{2}_3$. FIG. 9B shows the frame $\mathbf{2}_3$, in which the unit connector 3 receiving terminals 5 therein is fitted. In the multi-unit connector $\mathbf{1}_3$ shown in FIG. 9A, the front-half horizontal upper/lower inner walls 9 of the housing 4 of the unit connector 3 are formed shorter, and each pair of positioning ribs $\mathbf{10}_2$, $\mathbf{10}_2'$ of a connector frame $\mathbf{2}_3$ is arranged oppositely to each other in upper-lower direction in front of each of upper/lower inner walls 9 so as to make the slant surfaces 10*c* of the pair of positioning ribs $\mathbf{10}_2$, $\mathbf{10}_2'$ opposite to each other. The upper and lower top ends 14*e*, 14*f* of the female terminals 5 are abutted on the slant surfaces 10*c* of the positioning ribs $\mathbf{10}_2$, $\mathbf{10}_2'$, so that the terminal 5 is positioned in the upper/lower direction and the front/rear direction, and prevented from rattling. The positioning rib $\mathbf{10}_2'$ corresponds to an additional positioning rib.

Figure 10A:
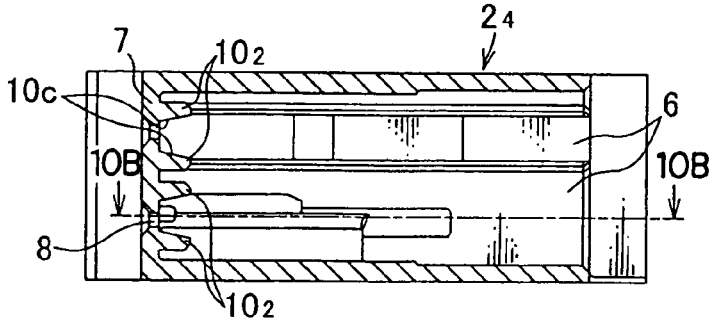
FIG. 10A is a vertical cross-sectional view of a connector frame showing a third embodiment of a positioning rib before assembling of a multi-unit connector.
Figure 10B:
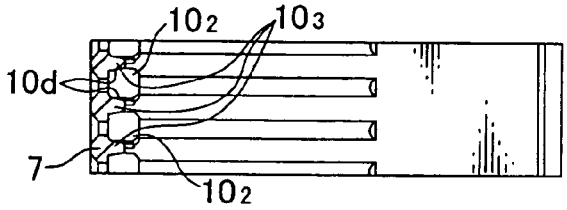
FIG. 10B is a cross-sectional view taken along the line 10B-10B of the connector frame shown in FIG. 10A.
Figure 10C:
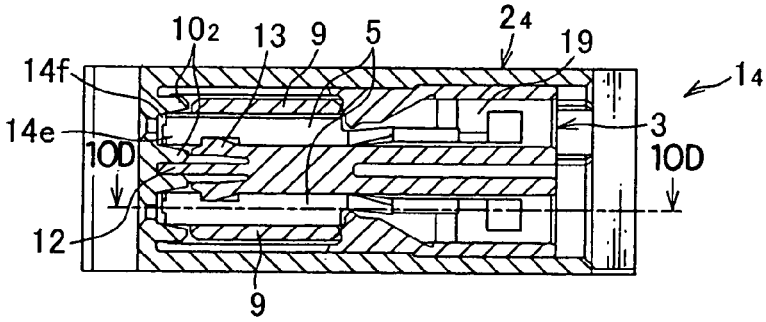
FIG. 10C is a vertical cross-sectional view of the multi-unit connector after assembling of the third embodiment.
Figure 10D:
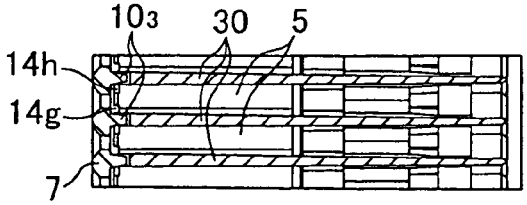
FIG. 10D is a cross-sectional view taken along the line 10D-10D of the multi-unit connector shown in FIG. 10C.
Figure 11A:
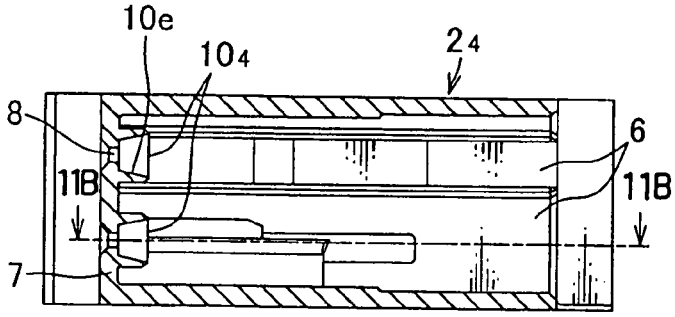
FIG. 11A is a vertical cross-sectional view of a connector frame showing a fourth embodiment of a positioning rib before assembling of a multi-unit connector.
Figure 11B:
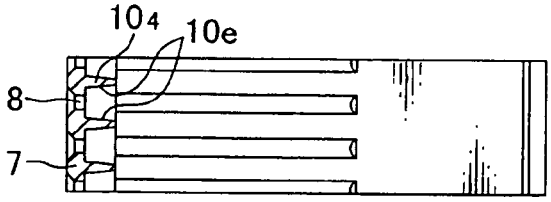
FIG. 11B is a cross-sectional view taken along the line 11B-11B of the connector frame shown in FIG. 11A.
Figure 11C:
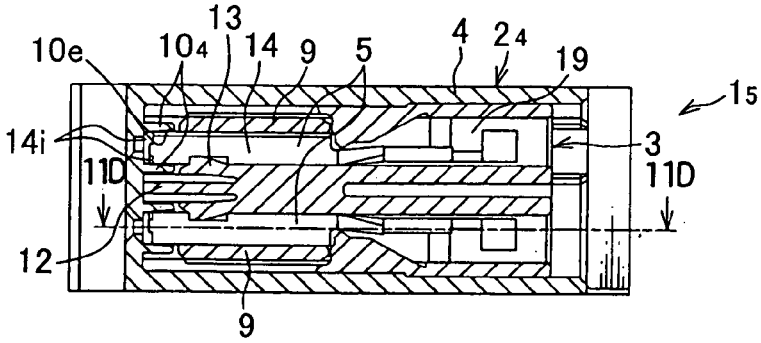
FIG. 11C is a vertical cross-sectional view of the multi-unit connector after assembling of the fourth embodiment.
Figure 11D:
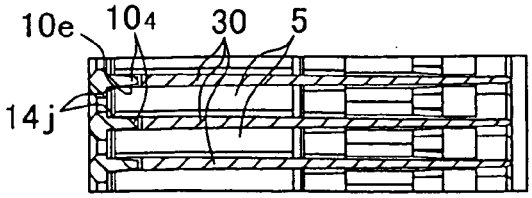
FIG. 11D is a cross-sectional view taken along the line 11D-11D of the multi-unit connector shown in FIG. 11C.

In a multi-unit connector $\mathbf{1}_4$ shown in FIGS. 10A-10D, additionally to the structure with the pair of positioning ribs $\mathbf{10}_2$ shown in FIGS. 9A, 9B, a pair of positioning ribs $\mathbf{10}_3$ symmetric in the right/left direction projects from the front vertical wall 7 of a connector frame $\mathbf{2}_4$ as shown in FIGS. 10B, 10D. The positioning ribs $\mathbf{10}_2$, $\mathbf{10}_3$ in four directions of upper/lower directions and right/left directions around the hole 8 form rectangular-shape wall. Each of positioning rib $\mathbf{10}_2$, $\mathbf{10}_3$ is provided at an inside thereof with a slant surface 10*c*, 10*d*. The upper, lower and right, left top ends 14*e*, 14*f*, 14*g*, 14*h* of the female terminals 5 are abutted on the corresponding slant surfaces 10*c*, 10*d* of the positioning ribs $\mathbf{10}_2$, $\mathbf{10}_2'$, so that the terminal 5 is positioned in the upper/lower direction, the right/left direction and the upper/lower direction, and prevented from rattling. A component of marking 30 in FIG. 10D corresponds to a vertical wall in the right/left direction of the terminal receiving section 19 of the housing 4.

In a multi-unit connector in FIGS. 11A-11D, instead of arranging the positioning ribs $\mathbf{10}_2$, $\mathbf{10}_3$ rectangularly in FIGS. 10A-10D, a positioning ribs $\mathbf{10}_4$ are formed with a circular shape around the hole 8, and a tapered surface 10*e* gradually thinner toward the top end of the positioning rib $\mathbf{10}_4$ is formed inside, facing the center of the hole 8, of the positioning rib $\mathbf{10}_4$. The top end corners 14*i*, 14*j* of the rectangular shape female terminals 5 are abutted on the tapered surfaces 10*e* of the positioning ribs $\mathbf{10}_4$, so that the terminal 5 is positioned in all direction including the upper/lower direction, the right/left direction, the upper/lower direction, additionally an upper/lower oblique direction and a right/left oblique direction, and prevented from rattling.

According to embodiments shown in FIGS. 7-11D, the top end of the terminal 5 in the unit connector 3 is positively positioned by the positioning rib $\mathbf{10}_2$-$\mathbf{10}_4$, so that the terminal 5 is prevented securely from rattling.

In the above embodiments, the multi-unit connector 1 having the female terminal 5 is described. According to the present invention, a multi-unit connector (not shown) having a male terminal (not shown) also can be formed. In the case, a rear-half of the male terminal (a rear body including an electric wire connecting portion) is received in a housing 4 of a unit connector 3, and a pin or tab shape electric contact portion of the terminal 5 is projected forwardly from the housing 4. The unit connector 3 is inserted and locked in a rear-half of a frame 2. The electric contact portion of the male terminal 5 is projected through a hole 8 for terminal insertion of a midpoint vertical wall 7 of the frame 2 into a hood portion 27, a front-half of the frame 2. A positioning rib 10 is formed in the vicinity of the hole 8 projectingly from an inner surface of the vertical wall 7. A midpoint (front end of the rear body) of the male terminal 5 is positioned (prevented from rattling) between the positioning rib 10 and a horizontal inner wall 9 of the housing 4.

What is claimed is:

1. A multi-unit connector comprising:

a plurality of unit connectors, each unit connector comprising a housing having a terminal receiving section, into which a terminal is inserted, and a front opening; and a connector frame mounting the plurality of unit connectors therein, and comprising a wall for covering the front opening, wherein the wall is provided with a hole aligning with the terminal receiving section and for receiving a mating terminal, and a terminal positioning rib projecting from the wall adjacent to the hole, wherein the terminal positioning rib controls the terminal to be positioned without rattling between the terminal positioning rib and an inner wall of the terminal receiving section which is opposed to the terminal positioning rib, said multi-unit connector further comprising a pair of the terminals, and a pair of terminal positioning ribs corresponding to the pair of the terminals and the pair of the terminal receiving sections, wherein the housing is provided with a partition wall between the pair of the terminals and the pair of the terminal receiving sections, and a front end of the partition wall is inserted in between the pair of the terminal positioning ribs.

2. The multi-unit connector according to claim 1, wherein the terminal positioning rib is provided with a slant surface for positioning a top end of the terminal.

3. The multi-unit connector according to claim 1, wherein an additional terminal positioning rib is arranged at the wall symmetrically against the positioning rib with respect to a center of the hole, and a slant surface for positioning a top end of the terminal is formed respectively at the positioning rib and the additional positioning rib so as to oppose to each other.

4. The multi-unit connector according to claim 1, wherein the terminal positioning rib is arranged at four directions of two horizontal directions and two vertical directions around a center of the hole, and a slant surface for positioning a top end of the terminal is formed respectively at a side, facing the center of the hole, of the each terminal positioning rib.

5. The multi-unit connector according to claim 1, wherein the terminal positioning rib is formed with a circular shape around a center of the hole, and a tapered surface for positioning a top end of the terminal is formed at a side, facing the center of the hole, of the terminal positioning rib.

6. A multi-unit connector comprising:

a plurality of unit connectors, each unit connector comprising a housing having a terminal receiving section, into which a terminal is inserted, and a front opening; and a connector frame mounting the plurality of unit connectors therein, and comprising a wall for covering the front opening, wherein the wall is provided with a hole aligning with the terminal receiving section and for receiving a mating terminal, and a terminal positioning rib projecting from the wall adjacent to the hole, wherein the terminal positioning rib controls the terminal to be positioned without rattling between the terminal positioning rib and an inner wall of the terminal receiving section which is opposed to the terminal positioning rib the housing further comprising a terminal lock lance, a front end of the terminal lock lance opposing a top end of the terminal positioning rib, said multi-unit connector further comprising a pair of the terminals, and a pair of terminal positioning ribs corresponding to the pair of the terminals and the pair of the terminal receiving sections, wherein the housing is provided with a partition wall between the pair of the terminals and the pair of the terminal receiving sections, and a front end of the partition wall is inserted in between the pair of the terminal positioning ribs.

* * * * *